United States Patent [19]

Palumbo

[11] Patent Number: 4,894,496

[45] Date of Patent: Jan. 16, 1990

[54] AUXILIARY WINDING CUT-OUT SWITCH FOR SUMP PUMP MOTOR

[76] Inventor: Nicholas R. Palumbo, 28 Redwood Dr., Cumberland, R.I. 02864

[21] Appl. No.: 213,089

[22] Filed: Jun. 29, 1988

[51] Int. Cl.[4] ..... H01H 35/10

[52] U.S. Cl. ..... 200/80 R; 310/68 E; 318/793

[58] Field of Search ..... 200/80 R; 310/68 E; 318/793

[56] References Cited

U.S. PATENT DOCUMENTS

| | | | |
|---|---|---|---|
| 3,293,388 | 12/1966 | Slonneger | 200/80 X |
| 3,381,197 | 4/1968 | Waters et al. | 200/456 |
| 3,691,415 | 9/1972 | Hancock et al. | 310/68 E |
| 3,790,730 | 2/1974 | Hildebrandt et al. | 310/68 E |
| 4,262,225 | 4/1981 | Hildebrandt et al. | 310/68 E |
| 4,284,864 | 8/1981 | Crow et al. | 200/80 R X |
| 4,504,710 | 3/1985 | Bryant et al. | 200/80 R |

*Primary Examiner*—A. D. Pellinen
*Assistant Examiner*—Morris Ginsburg
*Attorney, Agent, or Firm*—Sylvia L. Boyd

[57] ABSTRACT

An auxiliary winding cut-out switch for a sump pump motor having main windings and auxiliary windings. Controlled deflection means for positioning a contact carried on a terminal movable arm with respect to a fixed contact comprises a plunger, actuator, removable coil compression return spring and removable coil compression take-up spring, all concentric and colinear. The plunger slides in housing guide means and has a follower portion for following contact with a control surface carried on the motor rotor and axially movable responsive to rotor speed. The actuator slides in the housing guide means and has an offset coupler engaging the terminal movable arm. The take-up spring is seated between plunger and actuator; the return spring is seated between housing cover and actuator. The springs are electrically unconnected to the terminals.

The spring rates and dimensions are effective positively to position the actuator such that the contacts are held closed at motor speeds less than a predetermined speed, and positively to open the contacts when the motor attains the predetermined speed.

A combined main on/off switch and start winding cut-out switch is provided in a single housing, using three identical pairs of terminals.

9 Claims, 3 Drawing Sheets

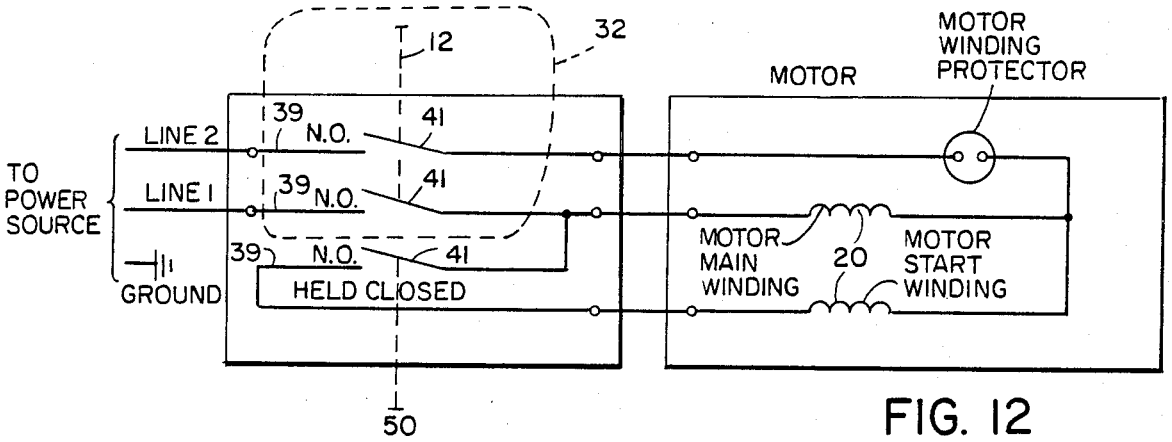
FIG. 12
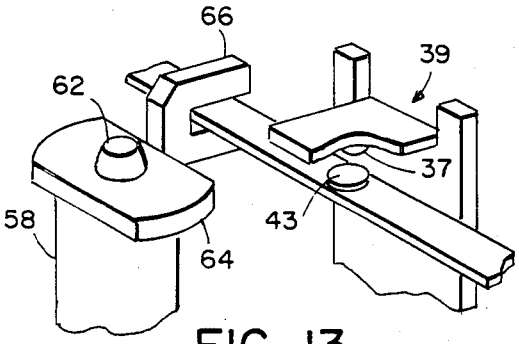
FIG. 13
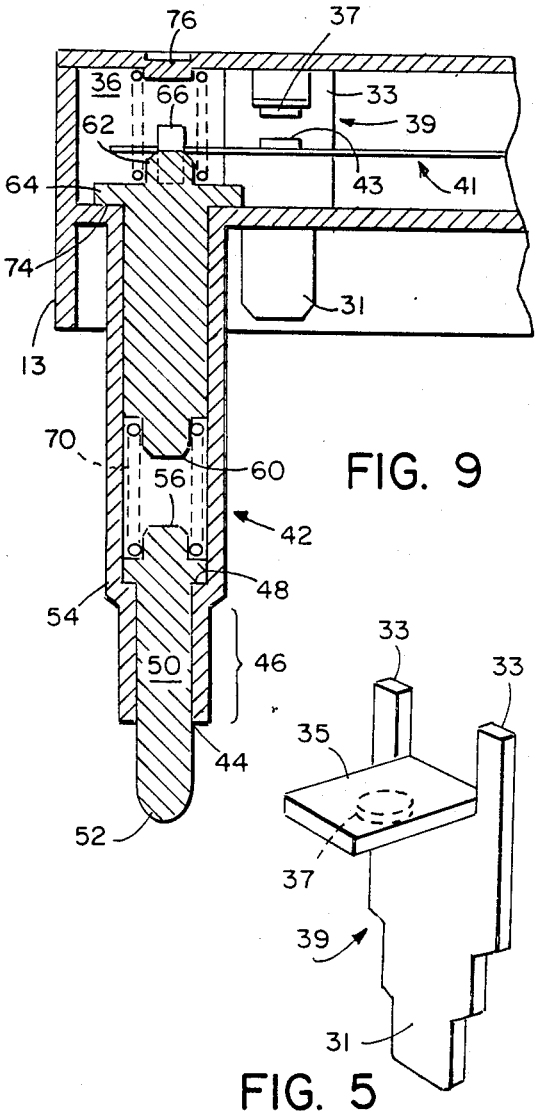
FIG. 9
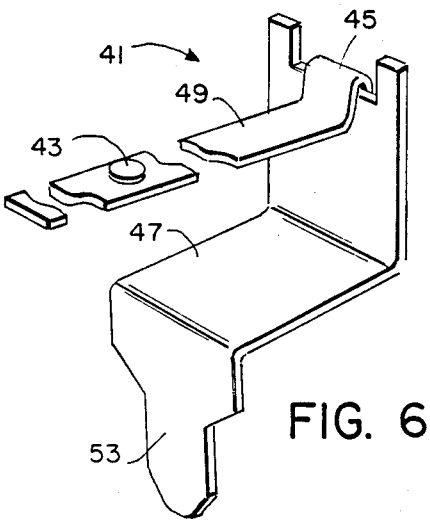
FIG. 6
FIG. 5

AUXILIARY WINDING CUT-OUT SWITCH FOR SUMP PUMP MOTOR

This application relates to a switch for cut-out of an auxiliary motor winding (start winding) after the motor reaches a predetermined speed. In particular, it relates to such a switch for use on the motor of a sump pump, that is, a pump which is partly or completely submerged in water which is to be pumped out of a sump or drainage reservoir.

BRIEF SUMMARY OF INVENTION

Auxiliary (start) windings are provided to assist the initial operation of the pump motor; however, within a very short time (typically half a second) the motor is operating at a speed such that operation with the auxiliary winding is in fact inefficient. Therefore it is desirable to provide a switch for cutting out the auxiliary winding promptly in response to motor speed.

The environment in which a sump pump operates is generally damp and humid, and in addition, the switch (if mounted on the outside of the motor housing) may be exposed to liquid water. Such an environment imposes safety requirements on the switch design. Furthermore, as a sump pump is generally used to prevent damage from flooding, and is frequently left to operate unattended, it is essential that the switch have a long useful lifetime, which is accurately predictable, and that it operate reliably over this lifetime.

An auxiliary winding cut-out switch is provided for use in controlling power from a power source to a sump pump motor having main windings and auxiliary windings. The motor rotor provides a control surface axially movable, responsive to rotor speed, between a first motor-off position and a second predetermined-speed position. A switch housing provides guide means and first and second terminal-retaining structures, and a housing cover provides a spring seat. A first electrically conductive terminal has a fixed contact, the terminal being fixed in the first terminal-retaining structure for electrical connection between a power source and the motor auxiliary windings; and a second electrically conductive terminal, fixed in the second terminal-retaining structure for electrical connection between the power source and the motor auxiliary windings, has a contact arm pivotable with respect to the second terminal-retaining structure, having a cooperating contact carried on the contact arm for cooperation with the fixed contact.

Controlled deflection means for positioning the cooperating contact with respect to the fixed contact comprises a generally cylindrical plunger axially slidable within the housing guide means and having: a follower portion for following contact with the control surface; a spring seat remote from the follower portion; and a stop portion engageable with the guide means for limiting axial travel of the plunger away from the housing. A generally cylindrical actuator is axially slidable within the guide means, and has a lower spring seat; an upper spring seat; a stop portion for limiting axial travel of the actuator away from the housing; and an offset coupler. A first removable coil compression spring is seated between the plunger spring seat and the actuator lower spring seat. A second removable coil compression spring is seated between the actuator upper spring seat and the cover spring seat. Neither spring is electrically connected with either terminal.

The plunger, actuator, guide means, cover spring seat, and springs are all concentric and colinear.

In preferred embodiments, the actuator offset coupler engages the second terminal contact arm at a point distal of the contacts with respect to the housing second terminal-retaining structure. The second terminal contact arm is resiliently pivotable about the second terminal-retaining structure. The springs have spring rates and dimensions effective, when the motor has not attained the predetermined speed, positively to position the actuator offset coupler at a predetermined height such that the contacts are held closed, and to permit further travel of the plunger toward the housing cover without substantial increase of force on the contact arm, and also effective, when the motor attains its predetermined speed, positively to open the contacts. The spring rates and dimensions are also effective, in the absence of contact between the plunger follower portion and the rotor control surface, positively to maintain the contacts open; the first spring remains in compression at any position of the control surface.

In a further aspect of the invention, the cut-out switch may be provided within a single housing with the main motor on/off switch. A housing provides three terminal chambers and an actuator chamber, each terminal chamber providing first and second terminal-retaining structures. One of the terminal chambers comprises a cut-off switch chamber; generally cylindrical guide means extends from the cut-off switch chamber. A housing cover provides a spring seat. In each terminal chamber, a terminal pair comprises an electrically conductive first terminal having a fixed contact, the first terminal being fixed in the first terminal-retaining structure for electrical connection between a power source and the motor; and a cooperating electrically conductive movable-arm terminal, fixed in the second terminal-retaining structure for electrical connection between the power source and the motor, having a contact arm pivotable with respect to the second terminal-retaining structure, and having a cooperating contact carried on the contact arm for cooperation with the fixed contact.

Bistable mechanical actuator means in the actuator chamber actuates two of the terminal pairs responsive to variation in external water level, the two terminal pairs and the actuator means together comprising a motor main winding on/off switch.

Adjacent the third terminal pair, controlled deflection means positions the third pair movable-arm terminal cooperating contact with respect to the third pair fixed contact. A generally cylindrical plunger is axially slidable within the housing guide means and has a follower portion for following contact with the control surface; a spring seat remote from the follower portion; and a stop portion engageable with the guide means for limiting axial travel of the plunger away from the housing. A generally cylindrical actuator is axially slidable within the guide means, and has a lower spring seat; an upper spring seat; a stop portion for limiting axial travel of the actuator away from the housing; and an offset coupler. A first removable coil compression spring is seated between the plunger spring seat and the actuator lower spring seat. A second removable coil compression spring is seated between the actuator upper spring seat and the cover spring seat. Both springs are electrically unconnected with either terminal of the third terminal pair. The plunger, actuator, guide means, cover spring seat, and springs are all concentric and colinear. Preferably, all the terminal pairs are identical.

BRIEF DESCRIPTION OF THE DRAWING

FIG.5 shows one of the fixed terminals;

FIG. 6 shows one of the movable-arm terminals;

FIG. 9 is taken on line 9—9 of FIG. 4, and shows the operative parts of the switch in assembled condition, in the state in which the auxiliary windings are cut out of the circuit;

FIG. 12 is a circuit diagram of the switch together with the main motor on/off switch; and FIG. 13 is a detail view of a portion of the apparatus shown in FIG. 9.

DETAILED DESCRIPTION

Figure 1:
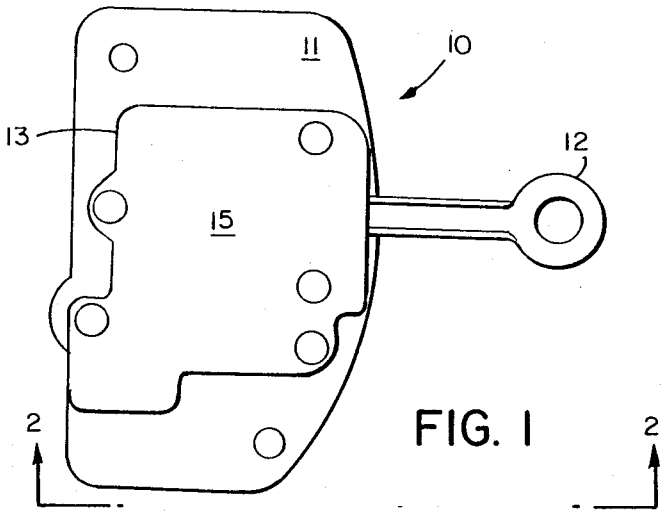
FIG. 1 is a top view of the switch housing.
Figure 2:
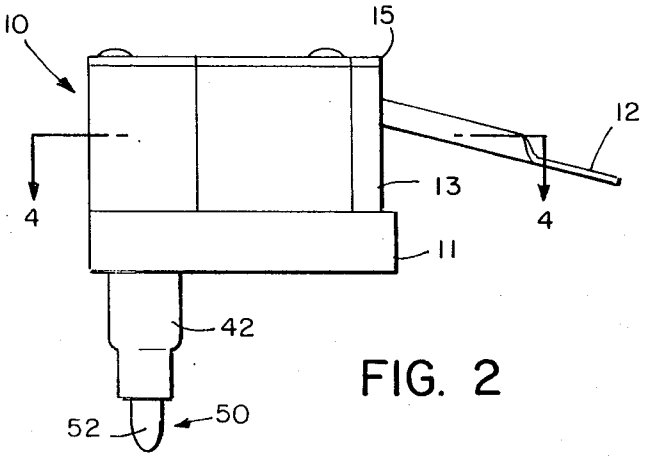
FIG. 2 is taken on line 2—2 of FIG. 1, and shows the switch exterior in the motor-off condition.
Figure 3:
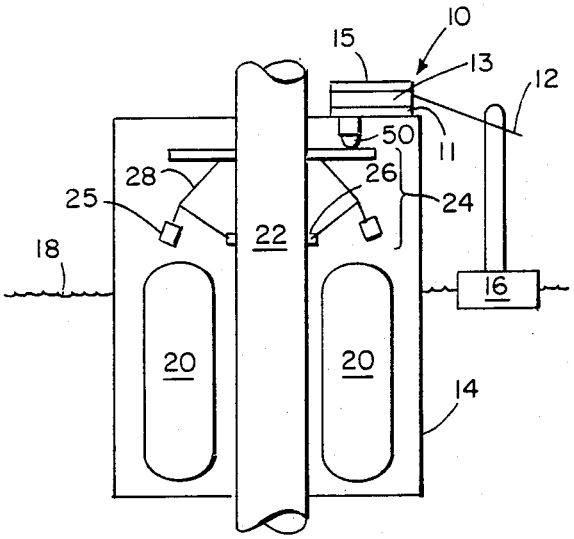
FIG. 3 shows the switch in place on the housing of a sump pump motor in a drainage reservoir, also in the motor-off condition.

Referring to the drawing, and in particular to FIGS. 1, 2 and 3, the switch of the invention is housed in switch housing 10, suitably molded of electrically insulating plastic material such as polyester, and comprising generally an attachment portion or bracket 11 and an upper housing 13. Bracket 11 and upper housing 13 may be molded as one piece. Switch housing 10 is closed by a cover 15, preferably stamped of a flame retardant material such as paper based phenolic laminate. An actuating lever 12 extends from upper housing 13.

As seen in FIG. 3, switch housing 10 is adapted to be attached, as by screws through bracket 11, to the exterior of a motor housing 14 of a motor which powers a sump pump (not shown). When switch housing 10 is so attached, and the pump is in operating position, actuating lever 12 is actuated in any suitable manner in response to the vertical displacement of a float 16, caused by variation in the level 18 of the water (or other fluid) being pumped. In the view seen in FIG. 3, the pump motor is off.

Generally, when water level 18 rises to some predetermined height, carrying with it float 16, actuating lever 12 is snapped to the motor ON position. When enough water has been pumped away that float 16 falls to some predetermined second height, actuating lever 12 is snapped to the motor OFF position.

The pump motor generally comprises stator windings 20 and a rotor or shaft 22, both shown only schematically; the details of such motors are well known in the art and form no part of the present invention. Windings 20 comprise main and auxiliary (start) windings, as seen in FIG. 12.

Figure 4:
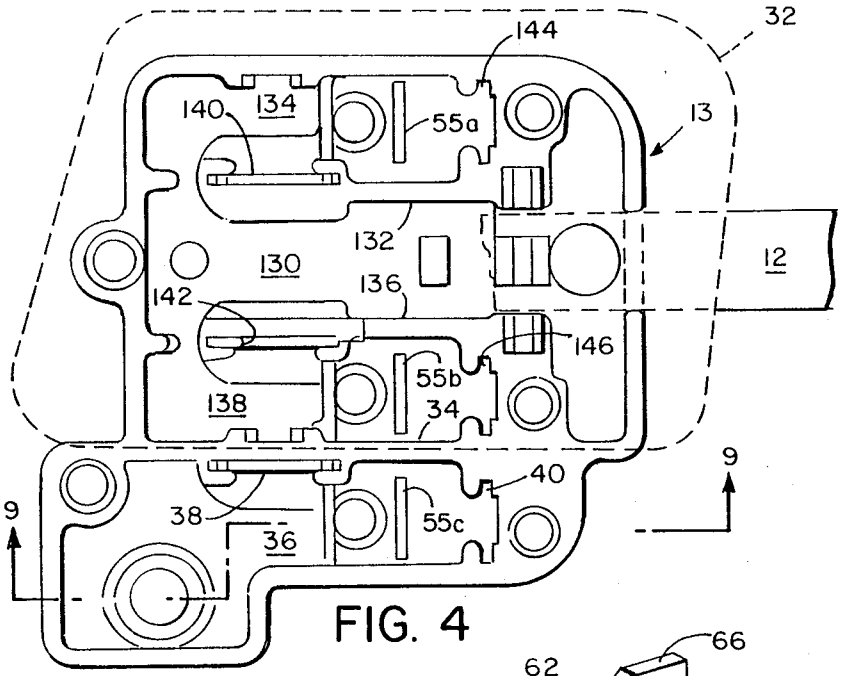
FIG. 4 is a view of the interior of the switch housing taken on line 4—4 of FIG. 2.

The main on-off switch will be described first. Referring now to FIG. 4, the portion of upper housing 13 enclosed within dotted line 32 houses switch structure for controlling power to the main windings of the motor. A pair of interior walls 132 and 136 divide the interior of the housing portion within dotted line 32 into three longitudinal chambers, central chamber 130 and side chambers 134 and 138. Central chamber 130 houses structure for providing the snap action of actuating lever 12, a portion of which is shown in phantom in FIG. 4. The snap action may be provided in any convenient manner; the particular structure for providing this function is not pertinent to the present invention. Motion of arm 12 between its two stable positions actuates the main on/off switch.

Referring to FIG. 5, a fixed terminal 39, stamped of brass or other suitable electrically conducting material, has a bent contact arm 35 carrying on its lower surface a contact 37, desirably a silver-cadmium oxide rivet. Fixed terminal 39 provides positioning ears 33. Tab end 31 of terminal 39 is provided for connection to other circuitry.

Referring to FIG. 6, movable-arm terminal 41 is preferably made of two elements, an electrically conducting movable contact-carrying arm 49 and an electrically conducting base 47. Arm 49 is preferably made of phosphorus bronze; contact 43 is a silver-cadmium oxide rivet. Base 47 is made of brass. Arm 49, base 47 and the terminal-retaining structure into which it fits are so designed that in assembled condition an interference fit is provided, to hold arm 49 in good connection to base 47 at bend 45. Bend 45 functions generally as a pivot point for the movable arm 49. Base 47 provides a tab end 53 for connection to other circuitry. Arm 49 is resilient, and provides a spring force which biasses contact 43 downwardly as seen in FIG. 6.

Referring again to FIG. 4, walls 132 and 136 provide structure at 140, 142 respectively, including floor slots, for the retention of two fixed terminals 39 of the kind shown in FIG. 5, and structure at 144, 146 respectively, with associated floor slots 55*a*, 55*b*, for the retention of two movable-arm terminals 41 of the kind shown in FIG. 6. Tab ends 31 and 53 extend downwardly through the respective floor slots. Referring to FIG. 12, two pairs of fixed and movable-arm terminals 39 and 41, within dotted line 32, provide switching electrical connection for the control of power from a power source, not shown, to the sump pump motor main windings, responsive to the snap action of actuating lever 12.

The operation of the cut-out switch will now be described. Referring again to FIG. 3, shaft 22 carries a centrifugal device 24, also well understood in the art and therefore shown only schematically. Device 24 is fixed to shaft 22 at base 26; a hinged arm 28 is attached to base 26. A disk or hat element 30 surrounds shaft 22 and is carried on arm 28, for rotation with shaft 22. Device 24 further comprises weights, as at 25, and operates such that in the motor OFF condition, centrifugal arm 28 is open (expanded); so that disk 30 is elevated on shaft 22. Device 24 is spring loaded to move rapidly between two stable positions. After the motor is turned on, when shaft 22 attains sufficient speed to throw weights 25 radially outwardly against the spring (not shown), arm 28 is thereby bent sharply, so that disk 30 drops with respect to shaft 22.

Housing interior wall 34 (FIG. 4) further divides side chamber 138 from cut-out switch chamber 36. Wall 34 provides structure including a floor slot at 38 for the retention of a fixed terminal 39 of the kind shown in FIG. 5, and structure at 40, with associated floor slot 55*c*, for the retention of a movable-arm terminal 41 of the kind shown in FIG. 6.

Upper housing 13 further provides integrally molded generally cylindrical actuator guide structure 42 open at the top to chamber 36, and further open at the bottom at edge 44 (FIG. 9). An internal shoulder 48 is provided, guide structure 42 being narrowed through a region 46 between bottom edge 44 and internal shoulder 48.

Figure 8:
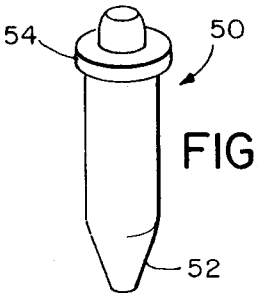
FIG. 8 shows the plunger.

Referring now to FIG. 8, a generally cylindrical plunger 50 is desirably molded of a long-wearing, self-lubricating material, such as molybdenum disulphide filled nylon. Plunger 50 provides a tapered bearing or following end 52 and a head 56, surrounded by a collar 54. Following end 52 bears against the surface of disk 30 during the start-up phase of the motor operation; because disk 30 rotates with shaft 22, this is a relatively high pressure-velocity interface and plunger 50 must withstand hard wear.

Figure 7:
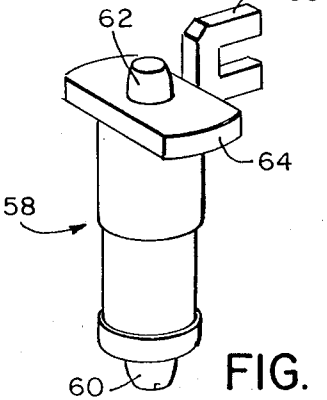
FIG. 7 shows the actuator.

Referring to FIG. 7, a generally cylindrical actuator 58 is desirably molded of material meeting the Underwriters Laboratory V-2 rating, for example polyester. Actuator 58 provides a lower spring seat 60 and an upper spring seat 62. Actuator 58 further provides stop shoulder 64 and offset coupler 66.

Further, two removable coil compression springs, a take-up spring 70 and a return spring 72 (FIG. 9), are provided. Springs 70 and 72 are desirably of stainless steel; the spring rates (force/inch) and dimensions of springs 70 and 72 are selected relative to one another to provide for positive positioning of movable arm 49 with contact 43 carried thereon, as will be described.

Referring now to FIG. 9, a portion of the cut-out switch is seen in assembled condition. Fixed terminal 39, carrying contact 37, is retained in structure 38 of housing interior wall 34. Ears 33 bear against cover 15, providing accurate positioning of terminal 39 and thereby of fixed contact 37. Terminal 41, with arm 49 carrying cooperating contact 43, is retained in structure 40 so that arm 49 is resiliently pivotable at 45 with respect to structure 40 and terminal base 47. Plunger 50 is sized and dimensioned with respect to guide structure 42 such that plunger 50 slides vertically smoothly within guide structure 42. At the lowest vertical position of plunger 50, plunger collar 54 engages interior shoulder 48, limiting downward travel of plunger 50 and retaining it within guide structure 42.

Take-up spring 70 is seated between plunger collar 54 and actuator lower spring seat 60. Actuator 58 is sized and dimensioned with respect to guide structure 42 to slide vertically smoothly within the upper part of guide structure 42. At the lowest vertical position of actuator 58, actuator stop shoulder 64 engages a stop surface 74 within cut-out switch chamber 36, to limit downward travel of actuator 58.

Return spring 72 is seated between upper spring seat 62 of actuator 58 and a cover spring seat 76, provided (extruded, as by punching) on the interior of cover 15. Actuator 58 is oriented within guide structure 42 such that offset coupler 66 engages the end of arm 49 of movable-arm terminal 41 that is distal with respect to bend 45, and with respect to contacts 37 and 43. Actuator 58, plunger 50, springs 70 and 72, and cover spring seat 76 are all concentric and colinear. Such arrangement provides smooth operation of the parts, without binding, and reduces the likelihood of switch failure caused by friction or wear of parts.

To assemble the cut-out switch of the invention, the parts within dotted lines 32 are assembled and plunger 50 is dropped into guide structure 42. Takeup spring 70 is then placed within guide structure 42, seated at 56. Actuator 58 and movable-arm terminal 41 may be assembled to guide structure 42, retaining structure 40 and associated floor slot 55*c* of chamber 36 in either order as convenient; arm 49 is engaged within offset coupler 66 and spring 70 is seated at 60. Fixed terminal 39 is then assembled to structure 38 in chamber 36. Return spring 72 is seated at 62, after which (and after the main on/off switch and lever 12 have been assembled) cover 15 is assembled to upper housing 13 such that spring 72 is seated on cover spring seat 76. Cover 15 is then secured to upper housing 13 in any suitable manner. Necessary electrical connections to the various terminals are made at tabs 31 and 53, after which housing 10 is attached to motor housing 14.

Figure 10:
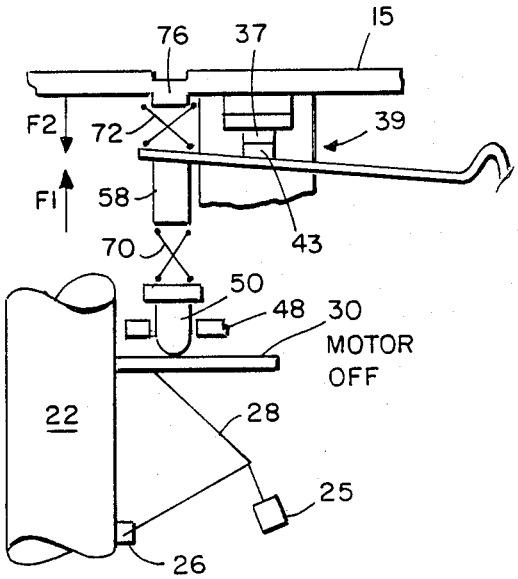
FIGS. 10 and 11 show schematically elements of the switch respectively in motor-off and motor-at-speed conditions.
Figure 11:
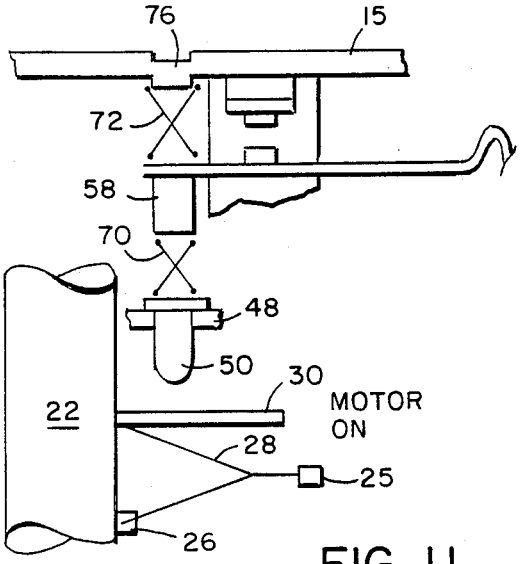

The operation of the cut-out switch according to the invention is seen schematically in FIGS. 10 and 11. When the motor is off (FIG. 10), centrifugal device arm 28 is open, holding disk 30 elevated with respect to base 26, which is fixed to rotor 22. Plunger 50, biassed by take-up spring 70 to follow the control surface of disk 30, is held up to compress take-up spring 70 whcih biasses actuator 58 upwardly. Return spring 72, seated against cover 15, biasses actuator 58 downwardly.

The spring rates and dimensions of springs 70 and 72 are chosen with respect to one another such that in the motor-off condition, offset coupler 66 is maintained at a predetermined vertical position such that contact 43 of pivotable arm 49 of terminal 41 is held firmly against fixed contact 39 but arm 49 is not overstressed. In the motor-off condition, the upward force (F1) of spring 70 is greater than the combined downward force (F2) of return spring 72 and resilient terminal arm 49.

Typically, the pump motor and the centrifugal device 24 are manufactured separately from the motor switch, so that positioning of disk 30 may not be precise or may vary from one motor to another. Positioning of the switch elements with respect to centrifugal device 24 and motor shaft 22 may therefore be somewhat imprecise, and vertical travel of disk 30 not accurately predictable at the time of manufacture of the switch. For this reason, the spring rates and dimensions of springs 70 and 72 are further chosen with respect to one another such that take-up spring 70 is not fully compressed at the position in which contacts 37 and 43 are positively held closed. Therefore further upward travel of disk 30 and plunger 50, if any, is taken up by take-up spring 70 without appreciable added force being exerted on arm 49 of terminal 41, thereby protecting resilient terminal arm 49 and contacts 39 and 43 from damage. The controlled deflection of arm 49, with positive positioning of contact 39 and 43, makes it possible to calculate the operating stresses in arm 49 accurately, thereby giving the switch a predictable life. Particularly in the sump pump application this is highly desirable.

Since the cut-out switch is held closed in the motor OFF position, when actuating lever 12 turns the motor ON, the auxiliary winding is connected into the circuit immediately.

Referring now to FIG. 11, after the motor is turned ON, shaft 22 rotates with increasing speed up to the speed at which weights 25 are thrown radially outward, causing centrifugal device 24 to snap to its other position. Disk 30 drops downward on rotor 22. Plunger 50 no longer touches disk 30. Plunger 50, biassed by take-up spring 70, drops through guide structure 42 to the point at which collar 54 engages shoulder 48. The spring rates and dimensions of springs 70 and 72 are chosen with respect to one another such that at this point force F2 becomes greater than F1, causing contacts 37 and 43 to open. The auxiliary winding is cut out of the circuit. The action of return spring 72 is such as to provide a force tending to positively open the contacts at the predetermined speed, even in the presence of welding or other sticking. This feature tends to prevent overload or overheating of the pump motor.

The spring rates and dimensions of springs 70 and 72 are chosen with respect to one another such that when plunger collar 54 engages shoulder 48, both springs 70 and 72 remain in compression, positively maintaining the vertical position of offset coupler 66 and therefore of resilient terminal arm 49.

This condition is maintained until the motor is stopped, whereupon the switch returns to the condition of FIG. 10.

In a particular embodiment, a return spring 72 half an inch long and having a spring rate of 1 ⅛lb/inch, with a take-up spring 70 half an inch long and having a spring rate of 4 lb/inch, is found to give a controlled deflection of ⅛ inch to actuator 58 and thereby to movable arm 49 of terminal 41, when the force provided from disk 30 is about one pound.

The cut-out switch has been designed to be manufactured and assembled as part of a unit which also comprises a snap-action ON/OFF switch of the kind described. In particular, the unit employs three fixed terminals all of the kind shown in FIG. 5. The movable arms 49 of all three movable-arm terminals are identical, being of the kind shown in FIG. 6.

The use of multiples of identical terminal elements, and the provision of both the main motor switch and the start winding cut-out switch in a single housing, makes the combined switch particularly economical to manufacture, as well as convenient and practical in use.

The provision of removable return spring 72 makes it unnecessary to rely on the spring force of resilient contact arm 49 for opening the cut-out switch; further, the design of the switch effectively protects arm 49 from being overstressed in the motor-off condition. These features make it possible to manufacture resilient terminal arm 49 of phosphorus bronze instead of beryllium copper, as would be necessary if the resilience of arm 49 were to be relied on alone to open the switch. Beryllium copper is more expensive than phosphorus bronze; additionally, it is a hazardous material, such that manufacturing operations involving this material cause problems of workplace safety and employer liability. It is therefore desirable to be able to avoid use of this material, as is made possible by the present switch design.

The design of the combined main switch and cut-out switch (FIG. 12), in which the cut-out switch is connected to the output of the main on-off switch (within dotted line 32, FIG. 4), ensures that the main switch must be closed before current flows to the auxiliary winding. This safety feature eliminates hazards, for example from a ground fault in the motor, and is particularly desirable in a water environment such as that in which the sump pump operates.

Since springs 70 and 72 are removable elements physically distinct from the terminals, and are independent of the structure providing electrical connections, in manufacture the switch can be easily reconfigured without any redesign or replacement of the terminals or other components, by substituting another pair of springs of the same dimensions and whose spring rates are in the same ratio; to cut out the auxiliary winding in response to a centrifugal device 24 which exerts a different force on plunger 50. The switch design is thereby made flexible and suitable for a wide variety of applications.

The design of the cut-out switch makes it a matter of choice to place the cooperating contacts on the under surface of fixed terminal arm 35 and the upper surface of pivotable arm 49 of the other terminal, or in the opposite orientation, and both embodiments are considered to be within the scope of the invention.

What is claimed is:

1. For use in controlling power from a power source to a sump pump motor having main windings and auxiliary windings, and having a rotor providing a control surface axially movable, responsive to rotor speed, between a first motor-off position and a second predetermined-speed position, which is assumed when said motor attains a predetermined speed an auxiliary winding cut-out switch comprising a housing providing guide means and first and second terminal-retaining structures, a housing cover providing a spring seat, a first electrically conductive terminal having a fixed contact, said first terminal being fixed in said first terminal-retaining structure for electrical connection between a power source and said motor auxiliary windings, a second electrically conductive terminal, fixed in said second terminal-retaining structure for electrical connection between said power source and said motor auxiliary windings, having a contact arm pivotable with respect to said second terminal-retaining structure, and having a cooperating contact carried on said contact arm for cooperation with said fixed contact, controlled deflection means for positioning said cooperating contact with respect to said fixed contact, comprising a first element axially slidable within said housing guide means and having a follower portion for following contact with said control surface, a first element spring seat remote from said follower portion, and a stop portion engageable with said guide means for limiting axial travel of said first element away from said housing, a second element axially slidable within said guide means, having a second element lower spring seat, an upper spring seat, a stop portion for limiting axial travel of said second element away from said housing, and an offset coupler, a first removable coil compression spring seated between said first element spring seat and said second element lower spring seat, said first spring being electrically unconnected with either said terminal, a second removable coil compression spring seated between said second element upper spring seat and said cover spring seat, said second spring being electrically unconnected with either said terminal, said first and second elements, said guide means, said cover spring seat, and said first and second springs all being concentric and colinear.

2. The switch of claim 1, said second element offset coupler engaging said second terminal contact arm at a point distal of said contacts with respect to said housing second terminal-retaining structure.

3. The switch of claim 1, said first and second springs having spring rates and dimensions effective, when said motor has not attained said predetermined speed, positively to position said second element offset coupler at a predetermined height such that said contacts are held closed, and to permit further travel of said first element toward said housing cover without substantial increase of force on said pivotable arm, and effective, when said motor attains said predetermined speed, positively to open said contacts.

4. The switch of claim 1, said first and second springs having spring rates and dimensions effective, in the absence of contact between said first element follower portion and said rotor control surface, positively to maintain said contacts open, said first spring remaining in compression.

5. The switch of claim 1, said second terminal contact arm being resiliently pivotable about said second terminal-retaining structure.

6. For use in controlling power from a power source to a sump pump motor having main windings and auxiliary windings, and having a rotor providing a control surface axially movable, responsive to rotor speed, between a first motor-off position and a second predetermined-speed position which is assumed when said motor attains a predetermined speed, an auxiliary winding cut-out switch comprising a housing providing guide means and first and second terminal-retaining structures, a housing cover providing a cover spring seat, a first electrically conductive terminal having a fixed contact, said first terminal being fixed in said first terminal-retaining structure for electrical connection between a power source and said motor auxiliary windings, a second electrically conductive terminal, fixed in said second terminal retaining structure for electrical connection between said power source and said motor auxiliary windings, having a contact arm resiliently pivotable about said second terminal-retaining structure, and having a cooperating contact carried on said contact arm for cooperation with said fixed contact, controlled deflection means for positioning said cooperating contact with respect to said fixed contact, comprising a first generally cylindrical actuator element axially slidable within said housing guide means and having a follower portion for following contact with said control surface, a spring seat remote from said follower portion, and a stop portion engageable with said guide means for limiting axial travel of said first element away from said housing, a second generally cylindrical actuator element axially slidable within said guide means, having a lower spring seat, an upper spring seat, a stop portion for limiting axial travel of said second element away from said housing, and a second actuator element offset coupler engaging said second terminal contact arm at a point distal of said contacts with respect to said housing second terminal-retaining structure, a first removable coil compression spring seated between said first element spring seat and said second element lower spring seat, said first spring being electrically unconnected with either said terminal, a second removable coil compression spring seated between said second element upper spring seat and said cover spring seat, said second spring being electrically unconnected with either said terminal, said first and second removable coil compression springs having spring rates and dimensions effective, when said motor has not attained said predetermined speed, positively to position said second actuator element offset coupler at a predetermined height such that said contacts are held closed, and to permit further travel of said first actuator element toward said housing cover without substantial increase of force on said contact arm, effective, when said motor attains said predetermined speed, positively to open said contacts, and effective, in the absence of contact between said first element follower portion and said rotor control surface, positively to maintain said contacts open, said first spring remaining in compression at any position of said control surface, said first and second elements, said guide means, said cover spring seat, and said first and second removable coil compression springs all being concentric and colinear.

7. For use in controlling power from a power source to a sump pump motor having main windings and auxiliary windings, and having a rotor providing a control surface axially movable, responsive to rotor speed, between a first motor-off position and a second predetermined-speed position, a switch comprising a housing providing three terminal chambers and an actuator chamber, each said terminal chamber providing first and second terminal-retaining structures, one of said terminal chambers comprising a cut-off switch chamber, said housing providing generally cylindrical guide means extending from said cut-off switch chamber, a housing cover providing a spring seat, in each said terminal chamber, a terminal pair comprising an electrically conductive first terminal having a fixed contact, said first terminal being fixed in said first terminal-retaining structure for electrical connection between a power source and said motor, and a cooperating electrically conductive movable-arm terminal, fixed in said second terminal-retaining structure for electrical connection between said power source and said motor, having a contact arm pivotable with respect to said second terminal-retaining structure, and having a cooperating contact carried on said contact arm for cooperation with said fixed contact, in said actuator chamber, bistable mechanical actuator means for actuating two of said terminal pairs responsive to variation in external water level, said two terminal pairs being connected to said motor main windings, said two terminal pairs and said mechanical actuator means together comprising a motor main winding on/off switch, adjacent a third said terminal pair, controlled deflection means for positioning said cooperating contact of said third chamber with respect to said third pair fixed contact, said controlled deflection means comprising a first generally cylindrical element axially slidable within said housing guide means and having a follower portion for following contact with said control surface, a spring seat remote from said follower portion, and a stop portion engageable with said guide means for limiting axial travel of said first element away from said housing, a second generally cylindrical element axially slidable within said guide means, having a lower spring seat, an upper spring seat, a stop portion for limiting axial travel of said second element away from said housing, and an offset coupler, a first removable coil compression spring seated between said first element spring seat and said second element lower spring seat, said first removable coil compression spring being electrically unconnected with either said terminal of said third terminal pair, a second removable coil compression spring seated between said second element upper spring seat and said cover spring seat, said second spring being electrically unconnected with either said terminal of said third terminal pair, said third terminal pair being connectable to a motor auxiliary winding, said first and second elements, said guide means, said cover spring seat, and said first and second springs all being concentric and colinear.

8. The switch of claim 7, all said terminal pairs being identical.

9. The switch of claim 7, said third terminal pair being connected for current flow to said third pair only in closed condition of said first and second terminal pairs.

* * * * *